US007909266B2

(12) United States Patent
Lo

(10) Patent No.: US 7,909,266 B2
(45) Date of Patent: Mar. 22, 2011

(54) OSCILLATING SPRINKLER WITH ADJUSTABLE MECHANISM

(76) Inventor: Shun-Nan Lo, Taichung (TW)

( * ) Notice: Subject to any disclaimer, the term of this patent is extended or adjusted under 35 U.S.C. 154(b) by 0 days.

(21) Appl. No.: 12/213,122

(22) Filed: Jun. 16, 2008

(65) Prior Publication Data

US 2009/0308950 A1 Dec. 17, 2009

(51) Int. Cl.
*B05B 3/16* (2006.01)

(52) U.S. Cl. ..... 239/242; 239/240; 239/562; 239/564; 239/566

(58) Field of Classification Search ..... 239/240, 239/242, 246, 562, 563, 564, 566, DIG. 1
See application file for complete search history.

(56) References Cited

U.S. PATENT DOCUMENTS

| | | | | |
|---|---|---|---|---|
| 5,657,928 | A * | 8/1997 | Jian | 239/242 |
| 6,062,490 | A * | 5/2000 | Katzer et al. | 239/246 |
| 6,135,356 | A | 10/2000 | Mitzlaff et al. | |
| 6,478,241 | B1 * | 11/2002 | Guo | 239/562 |
| 7,284,714 | B1 * | 10/2007 | Wang et al. | 239/562 |
| 7,607,590 | B2 * | 10/2009 | Nies | 239/242 |

* cited by examiner

*Primary Examiner* — Steven J Ganey

(57) ABSTRACT

An oscillating sprinkler includes two adjustment plate rotatably mounted on a hollow tube of the body of the sprinkler and nozzles extend through the hollow tube and guide slots defined through the adjustment plates. Each of the two adjustment plates has two control members on two sides thereof so as to pivot the adjustment plate individually relative to the hollow tube. A top cover is mounted to the adjustment plates and has multiple guide holes, the nozzles extend through the guide holes.

9 Claims, 28 Drawing Sheets

OSCILLATING SPRINKLER WITH ADJUSTABLE MECHANISM

FIELD OF THE INVENTION

The present invention relates to an oscillating sprinkler with two adjustable plates to respectively adjust orientation of nozzles to perform different patterns of sprinkling features.

BACKGROUND OF THE INVENTION

A conventional oscillating sprinkler is disclosed in German Patent 202004014604.2 and includes a curved plate composed of two plates which are installed in different directions so as to perform a fan-shaped sprinkling. Each plate includes an adjustment collar and multiple holes, the holes of the two plates are oriented in left and right directions so that when rotating the adjustment collars, the sprinkler performs a fan-shaped water curtain.

However, the adjustment collars are located at the rear end of the plates and when rotating the adjustment collars, the plates have to drive the nozzles to move together. The friction between the nozzles and the plates is significant so that the operation of the adjustment collars is not smooth as expected.

Another conventional oscillating sprinkler is disclosed in U.S. Patent Publication No. 2008/0054103A1 which includes a pair of control members on the single curved plate. The single curved plate cannot provide different types of sprinkling styles, only upright streams and fan-shaped curtains are available.

The present invention intends to provide an oscillating sprinkler which includes two adjustment plates and nozzles extend through guide slots defined through the adjustment plates, the two adjustment plates can be individually pivoted relative to an axis of the sprinkler by operation of two control members on two sides thereof so as to perform different types of water sprinkling features.

SUMMARY OF THE INVENTION

The present invention relates to an oscillating sprinkler which comprises a body having a hollow tube connected thereto and a plurality of holes are defined through a flat top surface of the hollow tube. A nozzle unit is received in the hollow tube and has a plurality of nozzles. Two adjustment plates are mounted to the flat top surface of the hollow tube and two first ends of the two adjustment plates are in contact with each other. Two respective second ends of the two adjustment plates are located on two respective opposite ends from the two respective first ends. Each adjustment plate has a plurality of guide slots and the nozzles extend through the holes and the guide slots. Two control members are connected to two sides of each of the adjustment plates and located close to the first or the second end of each of the adjustment plates. The two adjustment plates are pivotable relative to an axis of the hollow tube respectively. A top cover is mounted to the adjustment plates and has multiple guide holes and the nozzles extend through the guide holes.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 12:
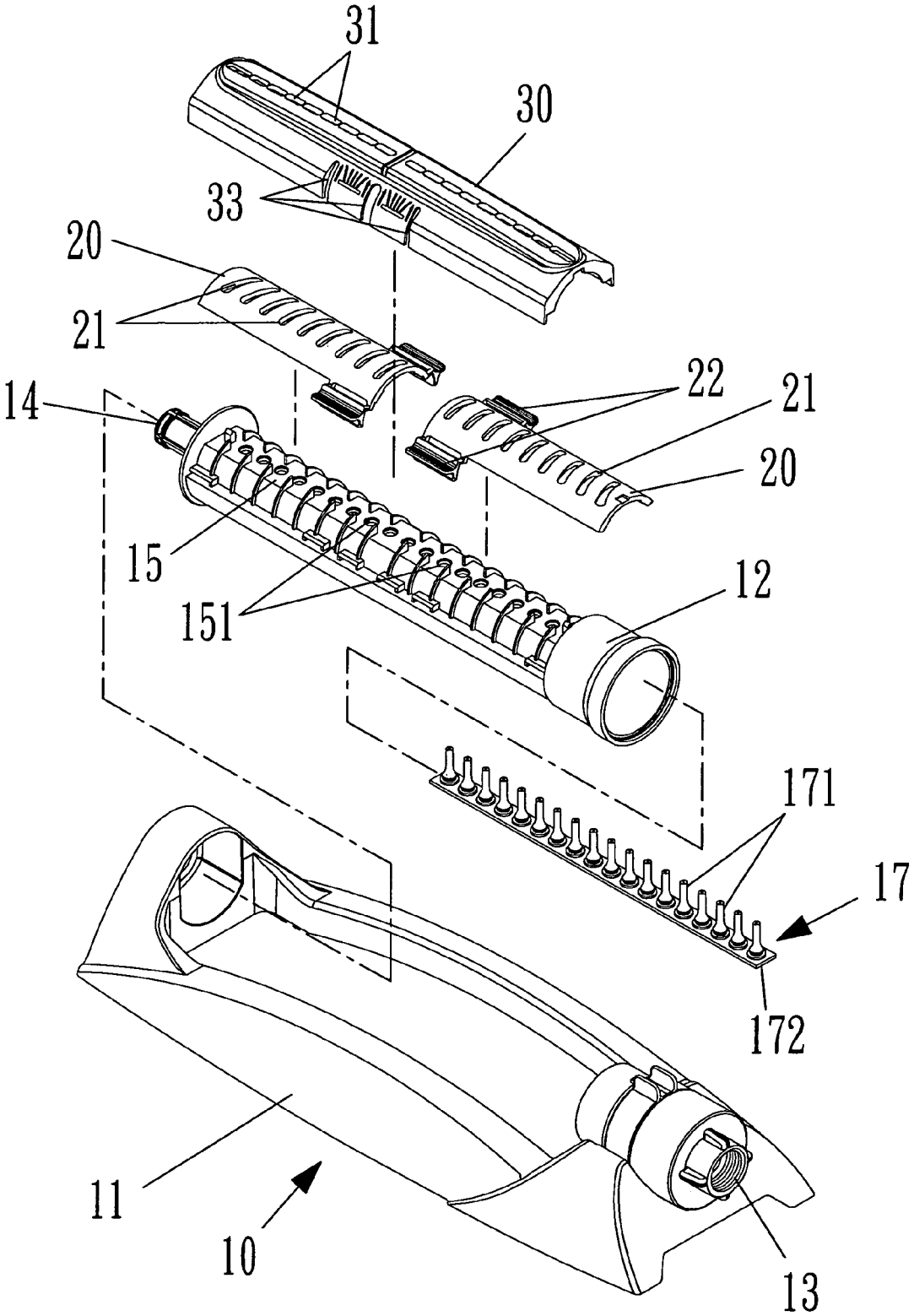
FIG. 12 is an exploded view to show the second embodiment of the oscillating sprinkler of the present invention.
Figure 13:
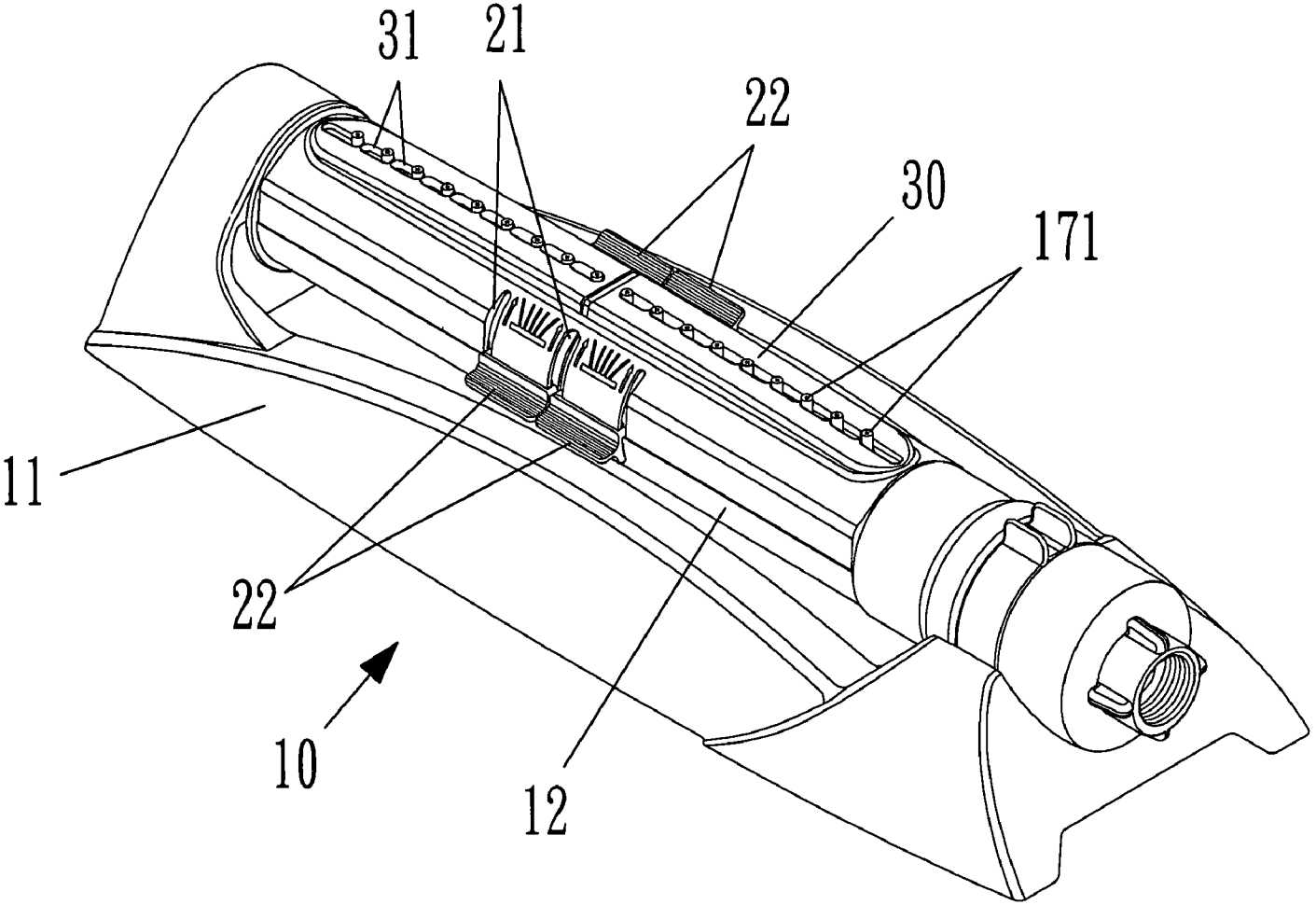
FIG. 13 is a perspective view to show the second embodiment of the oscillating sprinkler of the present invention.
Figure 14:
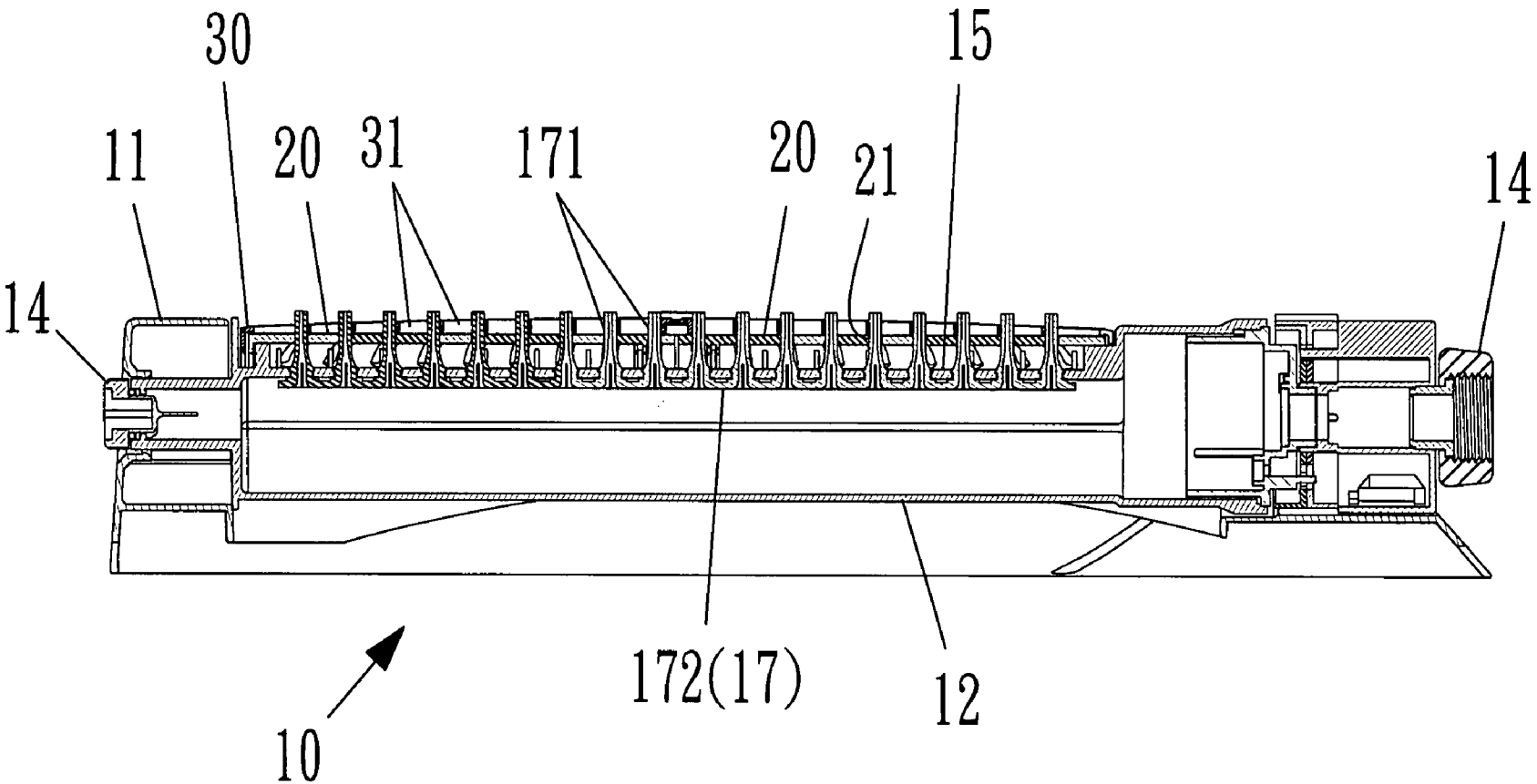
FIG. 14 shows a side cross sectional view of the second embodiment of the oscillating sprinkler of the present invention.
Figure 15:
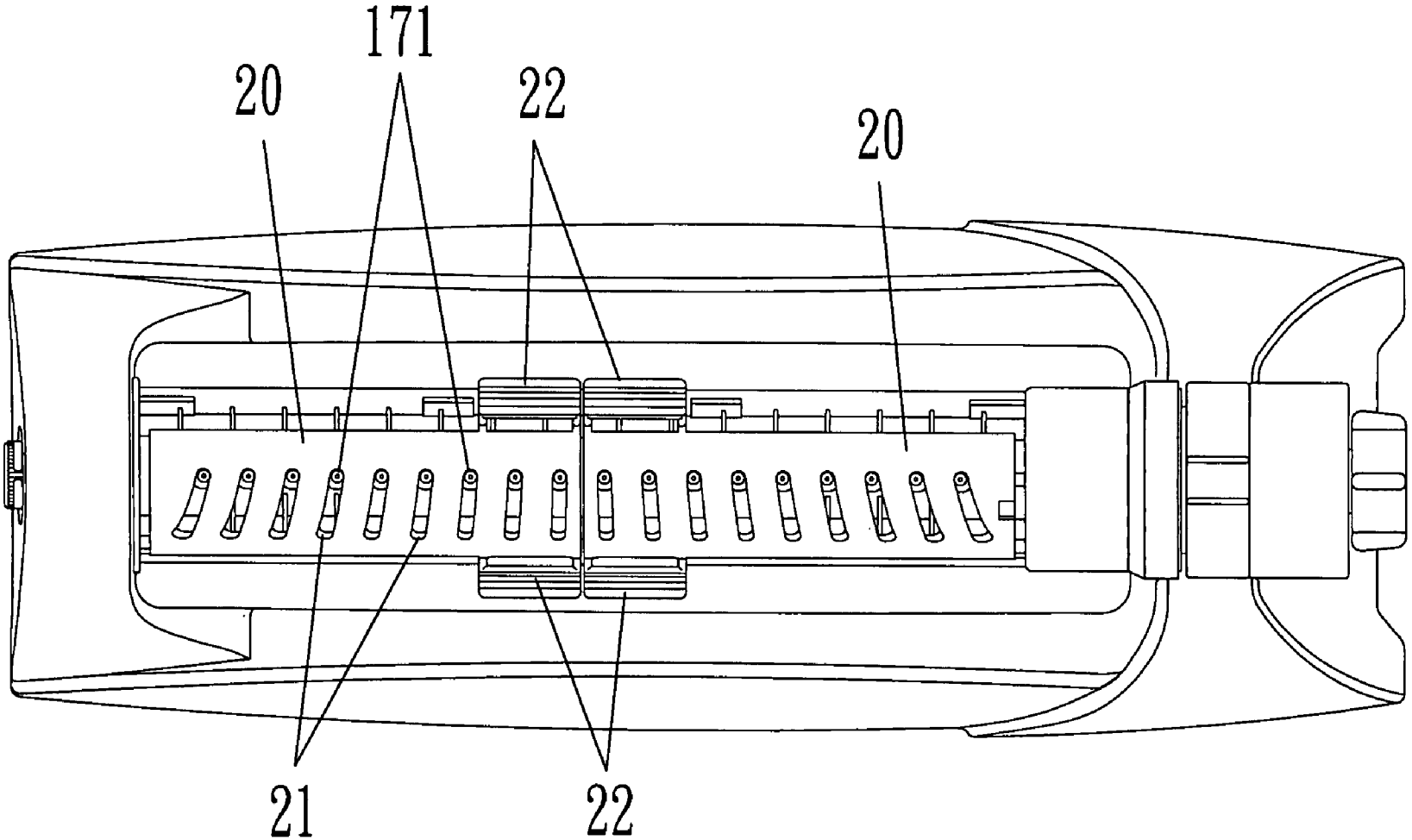
FIGS. 15 and 16 show top views of the second embodiment of the oscillating sprinkler of the present invention, wherein the adjustment plates are pivoted.
Figure 16:
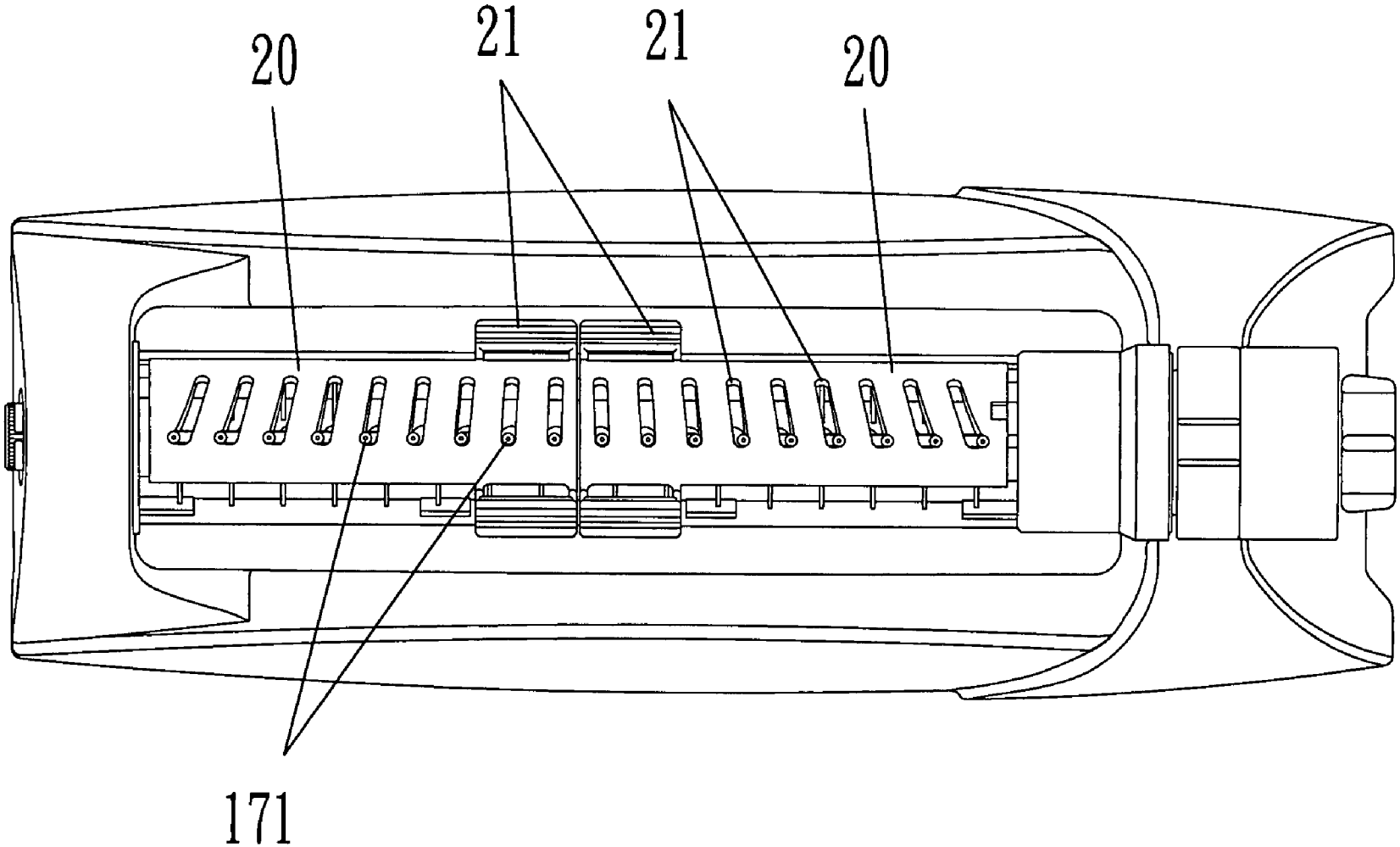
Figure 17:
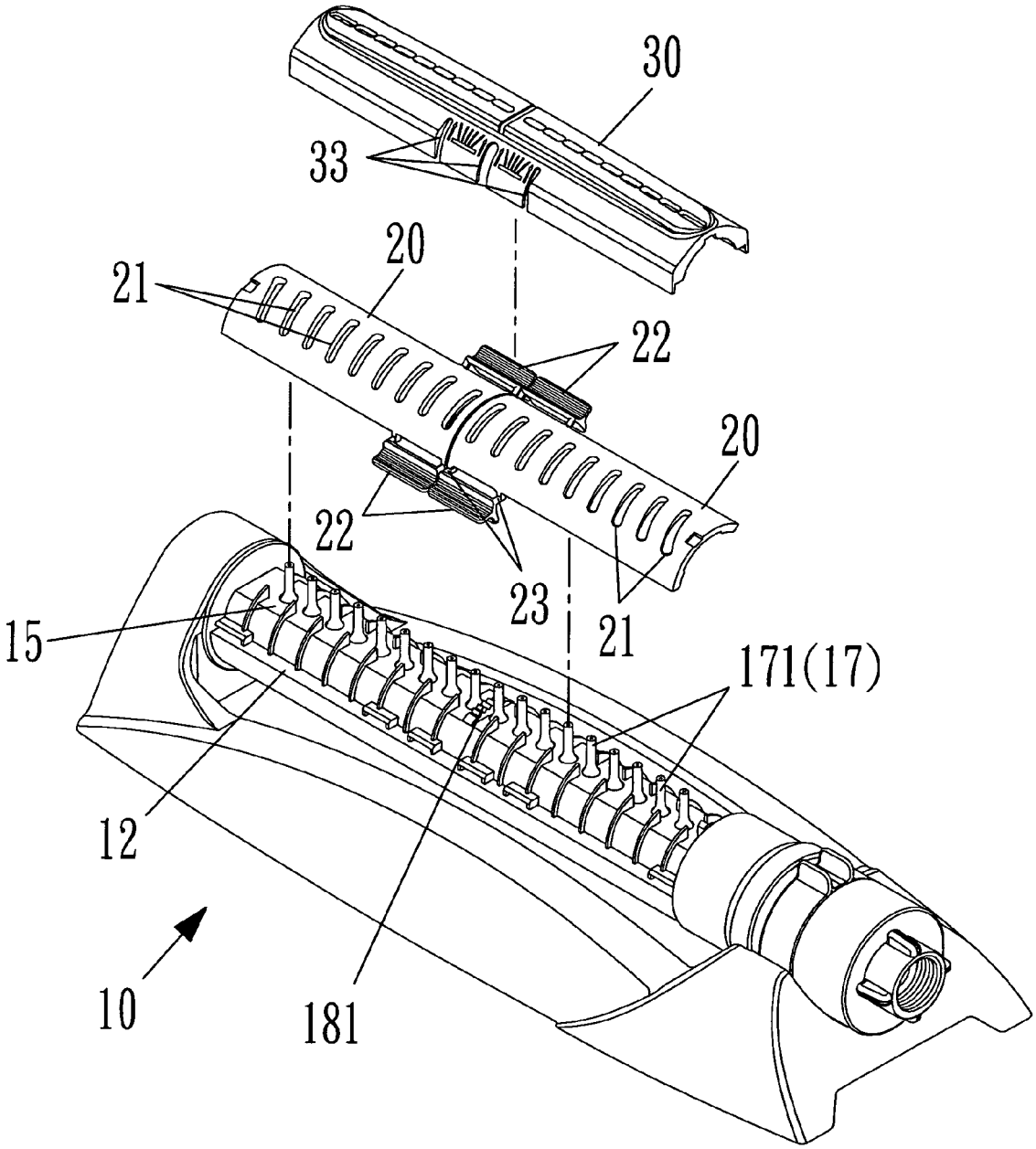
FIG. 17 is an exploded view to show the third embodiment of the oscillating sprinkler of the present invention.
Figure 18:
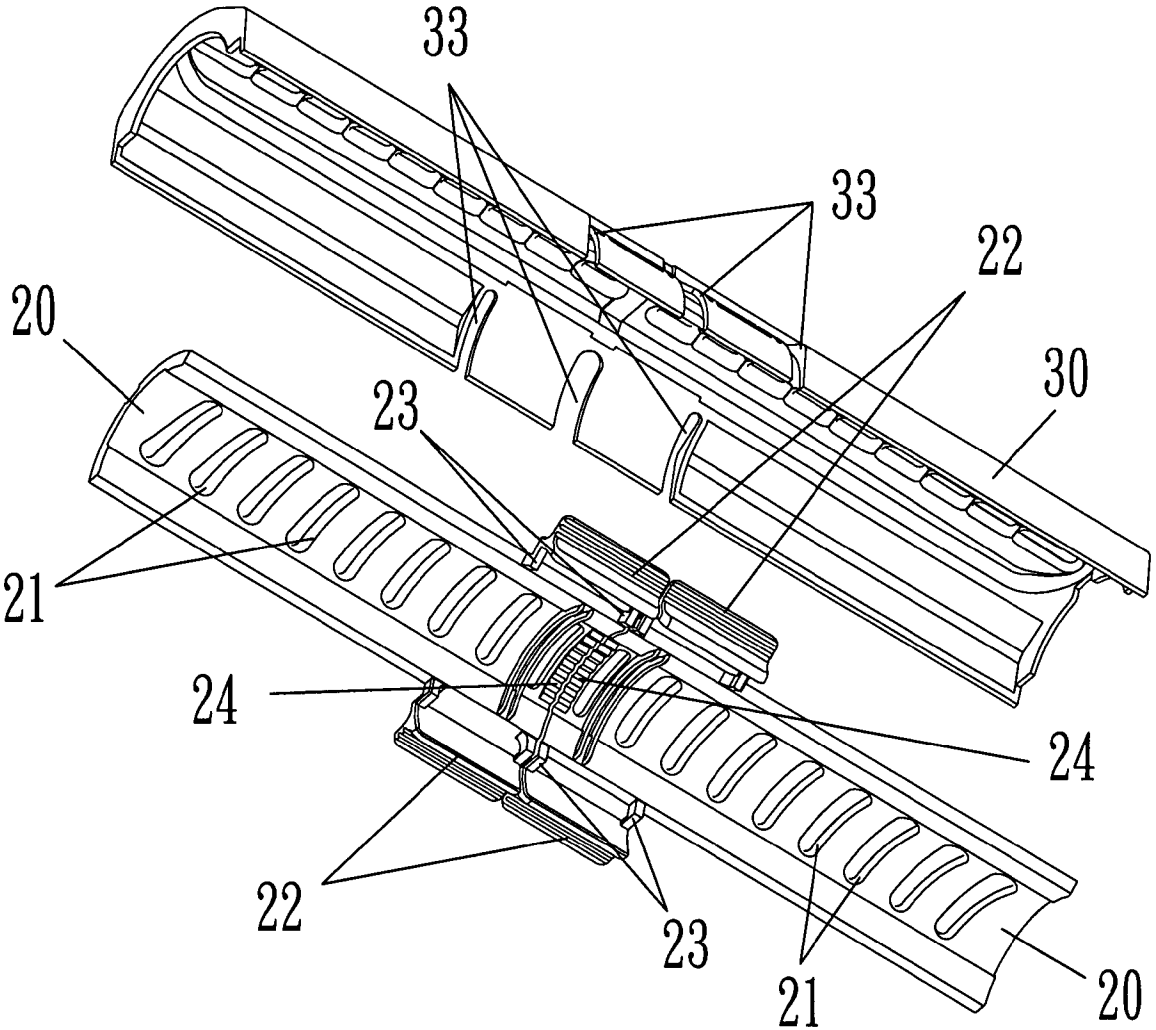
FIG. 18 shows a bottom view of the adjustment plates and the top cover of the third embodiment of the oscillating sprinkler of the present invention.
Figure 19:
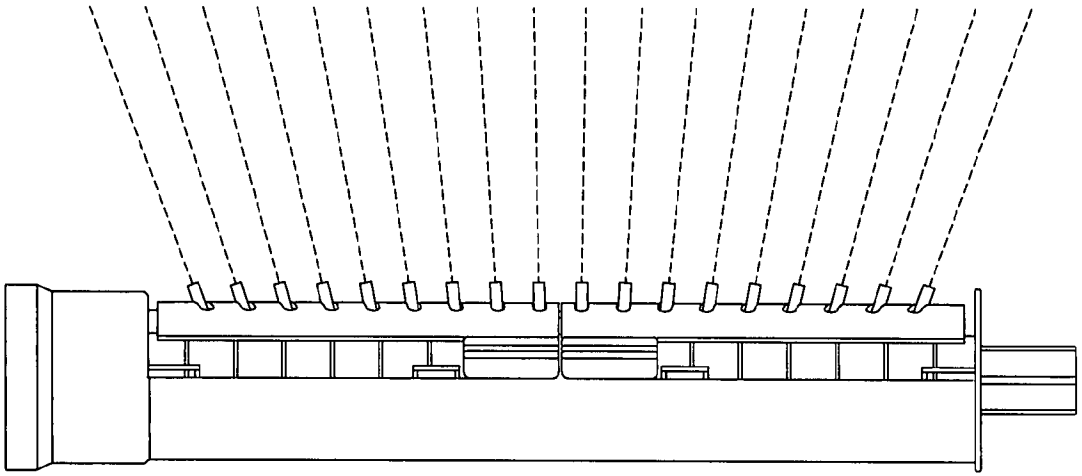
FIGS. 19-24 show different patterns that the oscillating sprinkler of the third embodiment of the present invention may perform.
Figure 20:
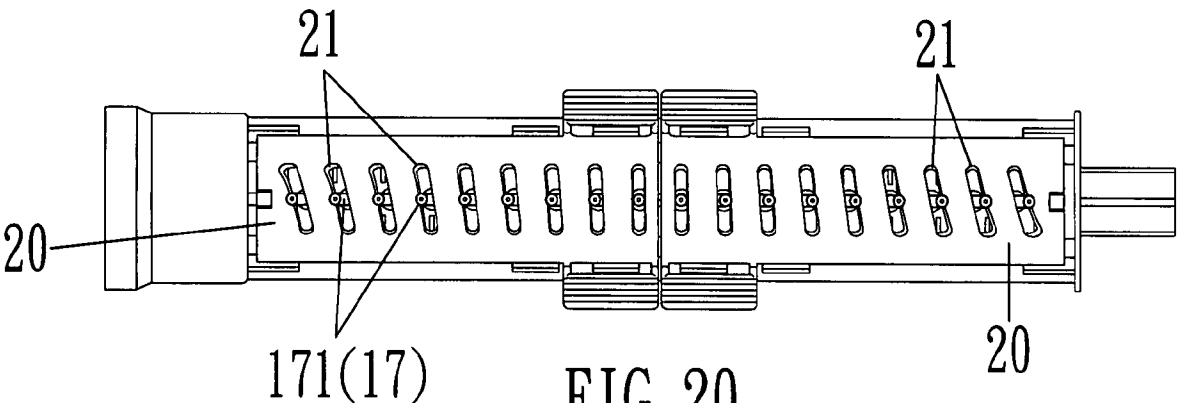
Figure 21:
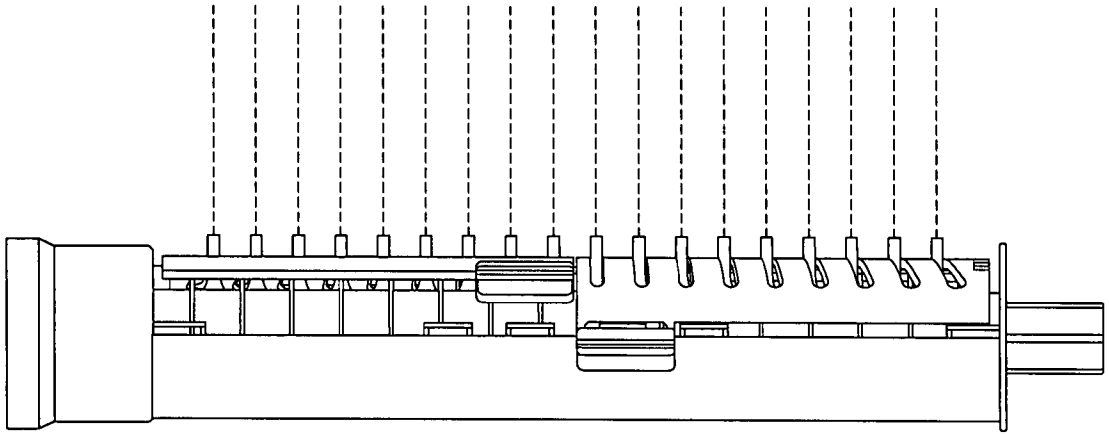
Figure 22:
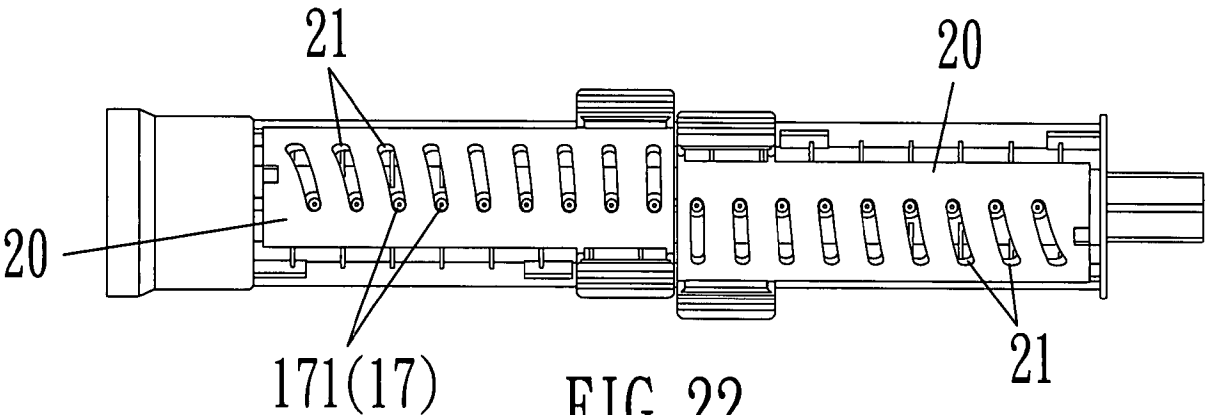

Referring to FIGS. 1 to 4 and 5, the oscillating sprinkler of the present invention comprises a body 10 having a frame with a hollow tube 12 connected thereto and a fixture 13 is connected to one end of the hollow tube 12 so as to be connected with a hose (not shown), and an end seal 14 (FIG. 12) is connected to the other end of the hollow tube 12. The hollow tube 12 has a flat top surface 15 and a plurality of holes 151 are defined through the flat top surface 15. A nozzle unit 17 is received in the hollow tube 12 and includes a connection plate 172 on which a plurality of nozzles 171 extend. The nozzles 171 extend through the holes 151.

Figure 1:
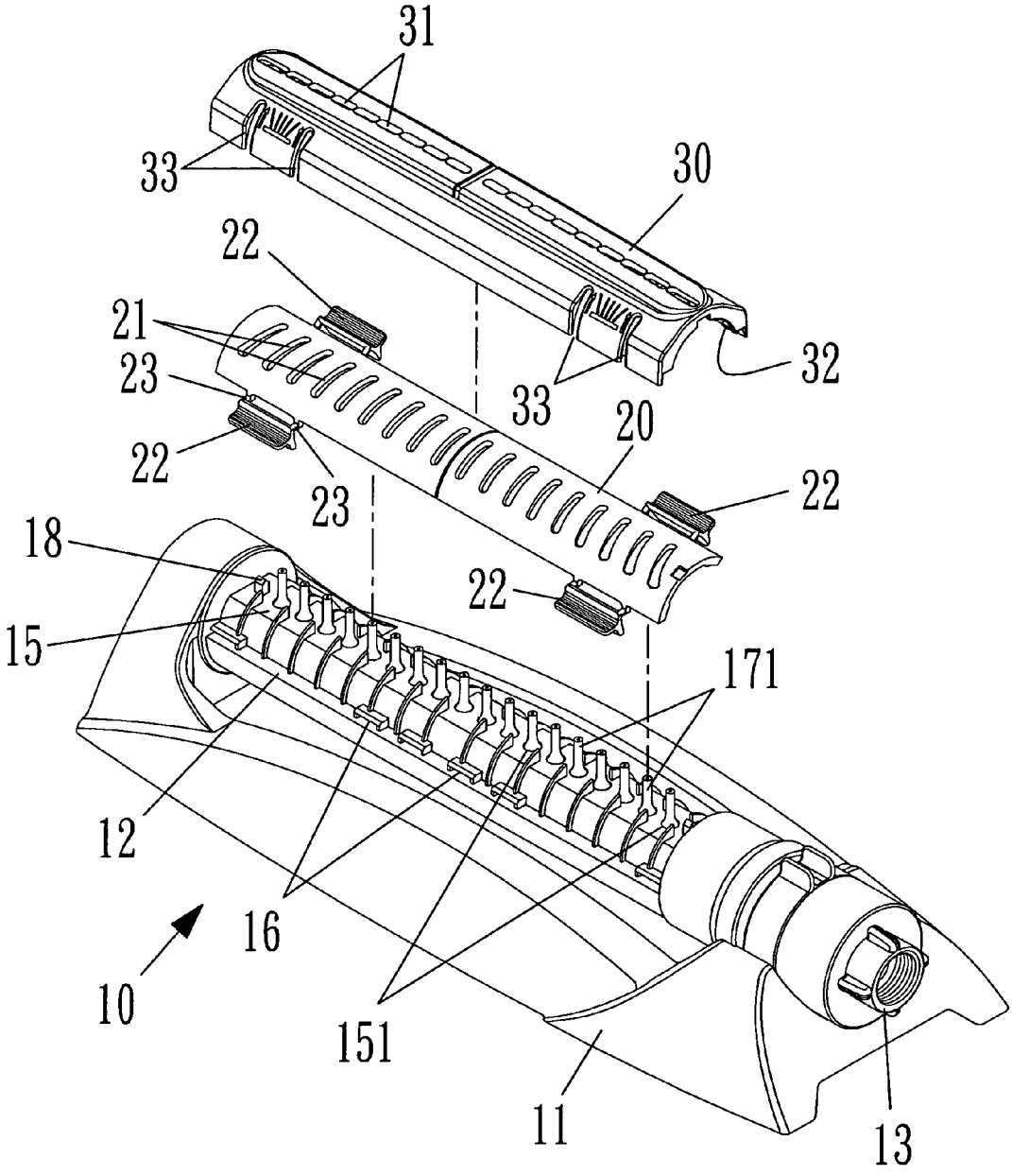
FIG. 1 is an exploded view to show the first embodiment of the oscillating sprinkler of the present invention.
Figure 2:
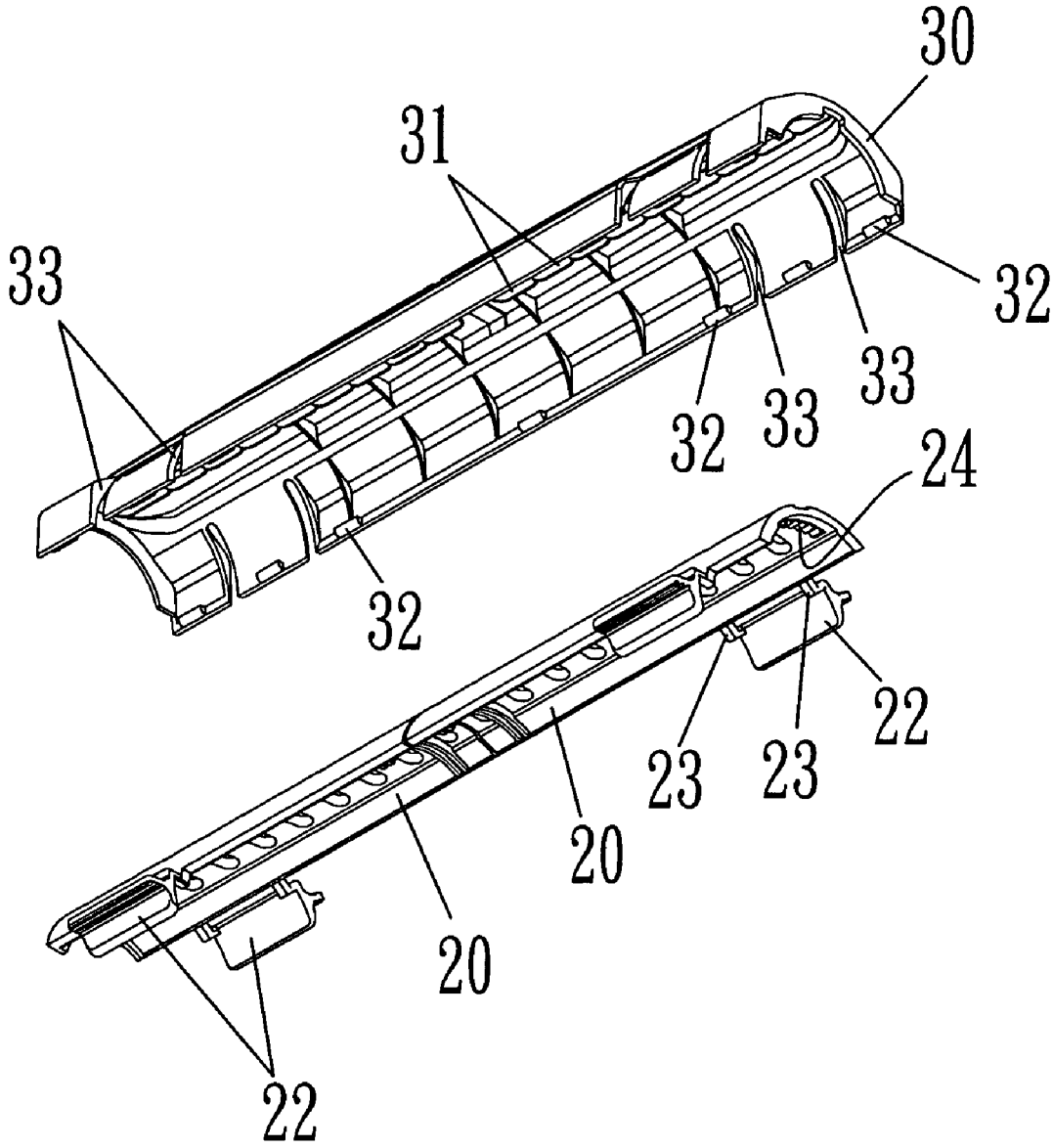
FIG. 2 shows a bottom view of one of the adjustment plates and the top cover of the oscillating sprinkler of the present invention.
Figure 3:
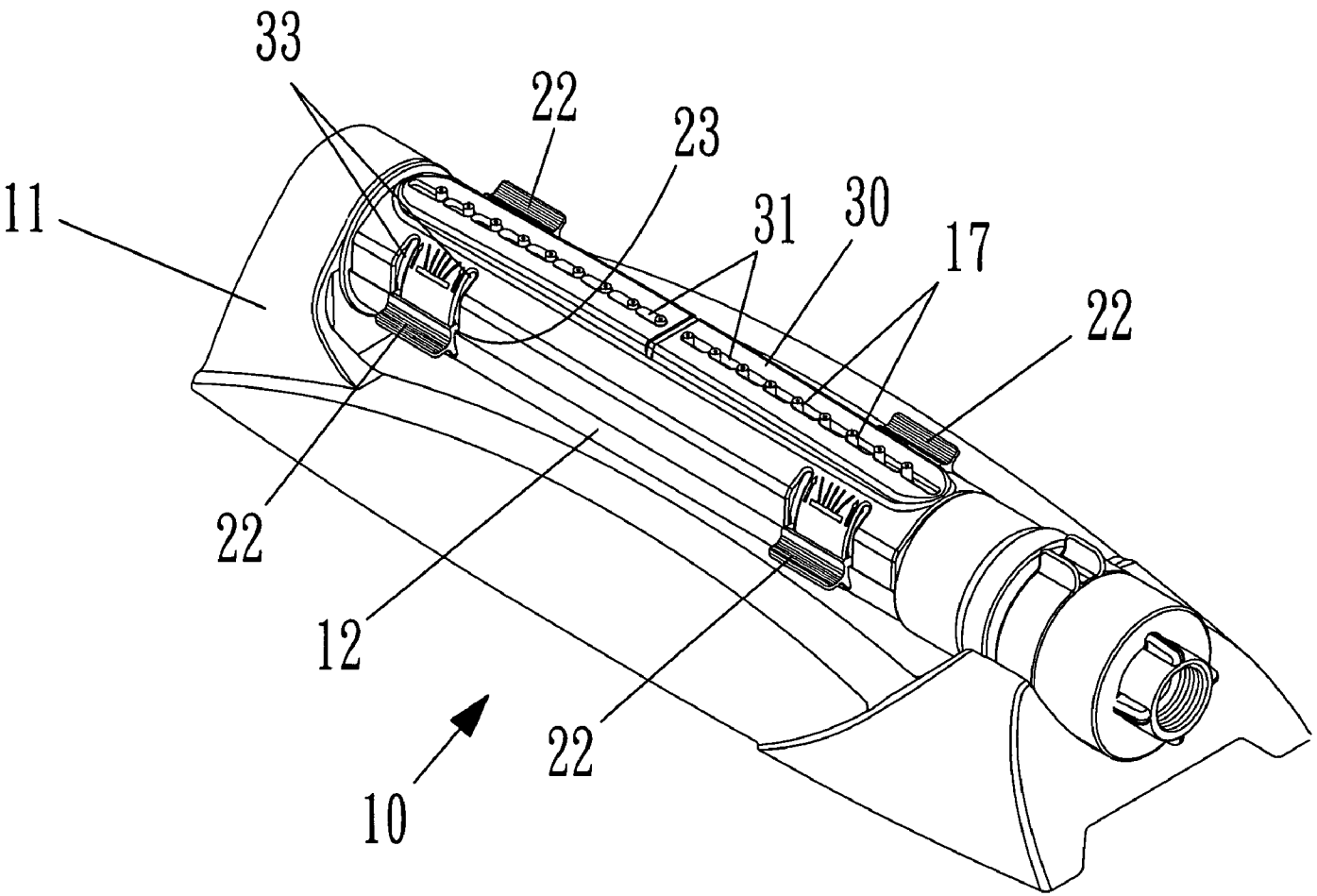
FIG. 3 is a perspective view to show the oscillating sprinkler of the present invention.
Figure 4:
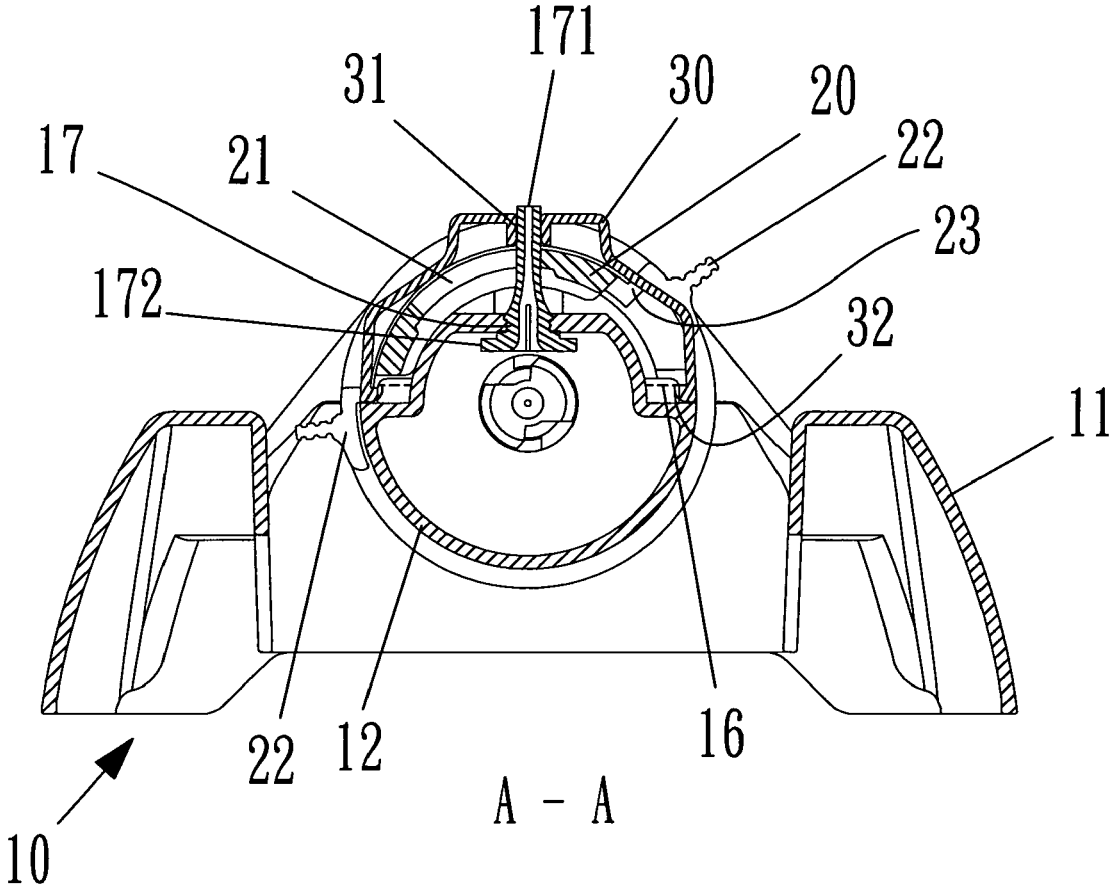
FIG. 4 is a partial cross sectional view along line A-A in FIG. 5.
Figure 5:
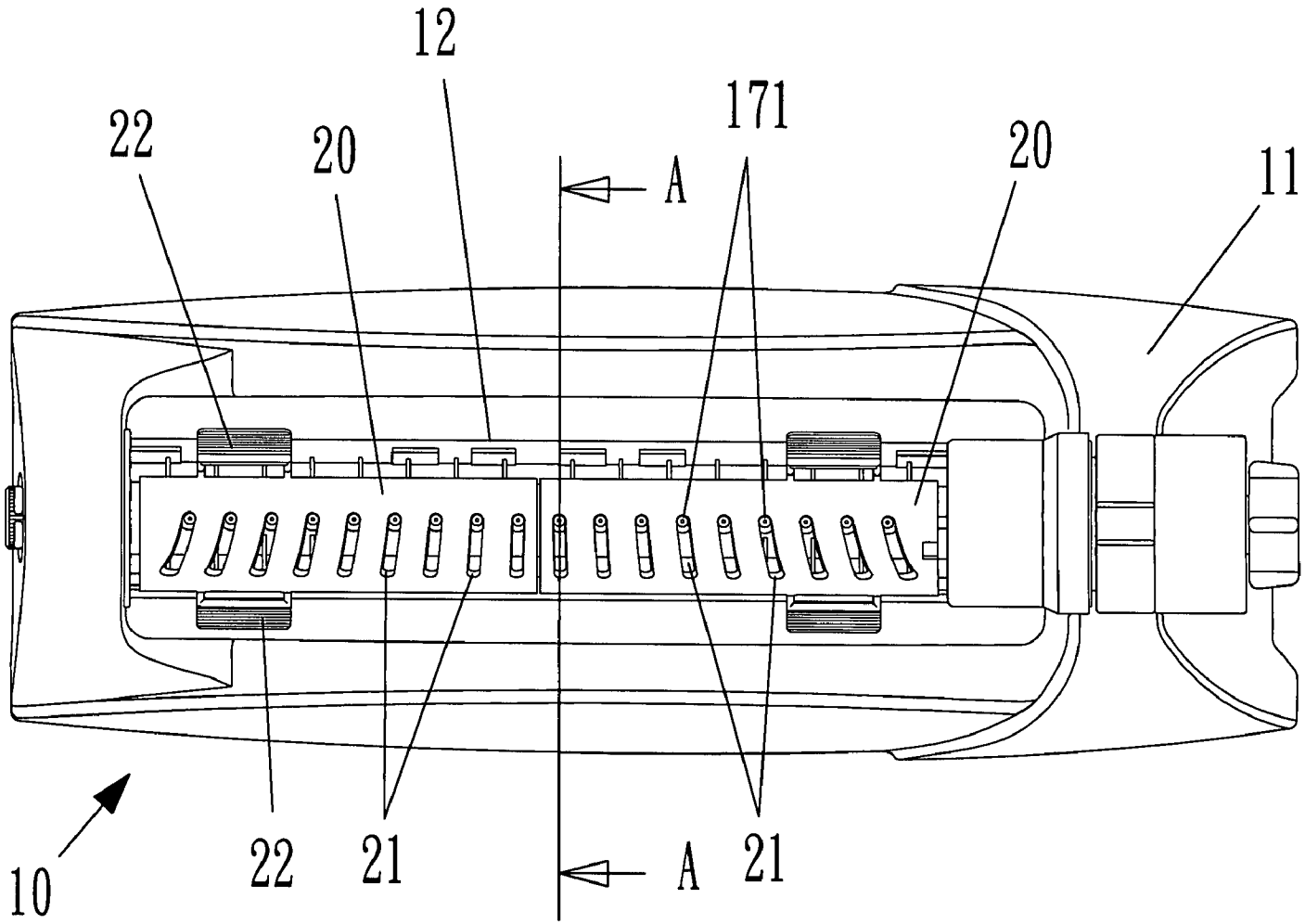
FIG. 5 shows a top view of the oscillating sprinkler of the present invention.
Figure 6:
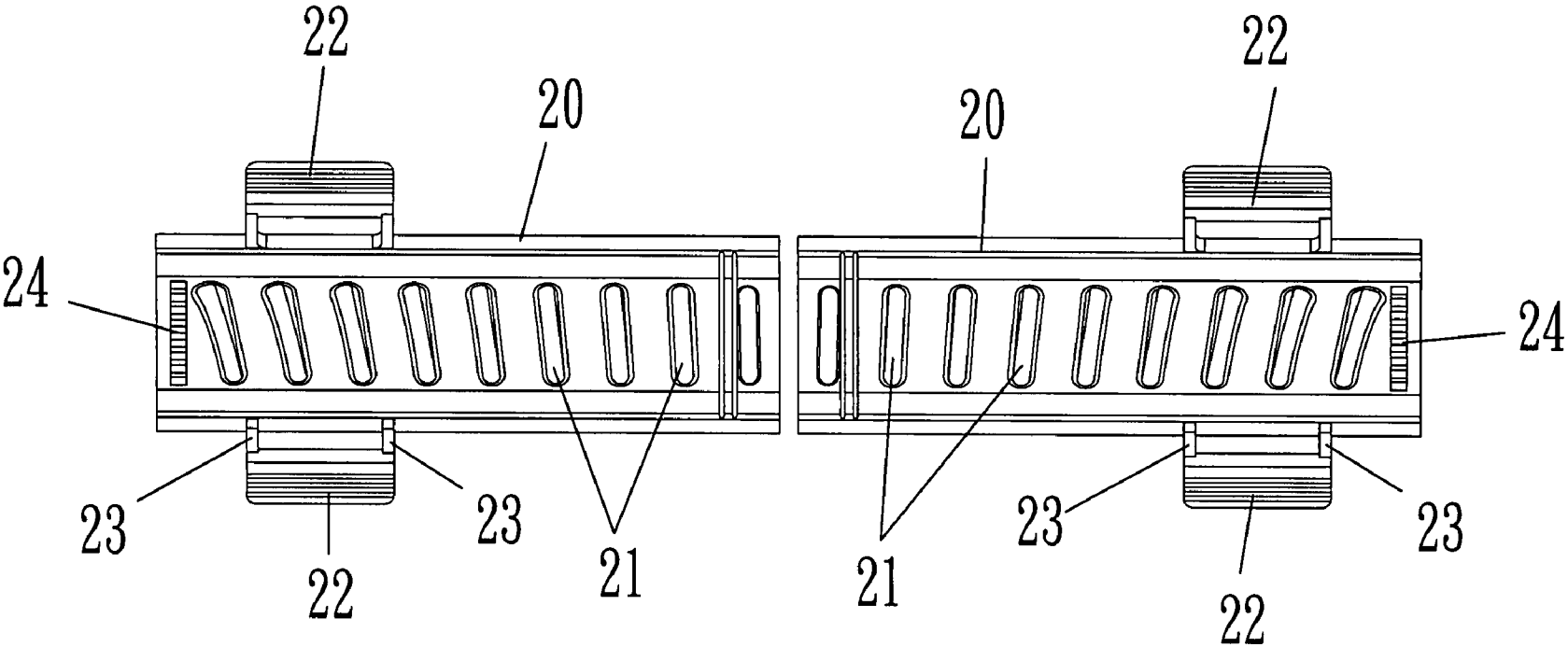
FIG. 6 shows the top view of the adjustment plates of the oscillating sprinkler of the present invention.

Two adjustment plates 20 are mounted to the flat top surface 15 of the hollow tube 12 and two first ends of the two adjustment plates 20 are in contact with each other. Two respective second ends of the two adjustment plates 20 are located on two respective opposite ends to the two respective first ends. A length of the two adjustment plate 20 is the same as a length of the hollow tube 12. Each adjustment plate 20 has a plurality of guide slots 21 defined therethrough and the nozzles 171 extend through the holes 151 and the guide slots 21. Referring to FIGS. 5 and 6, the two respective guide slots 21 located close to the two respective first ends of the two adjustment plate 20 are parallel to each other, the rest of the guide slots 21 are gradually inclined at an angle.

Two control members 20 are connected to two sides of each of the two adjustment plates 20 and located close to the second end of each of the adjustment plates 20. Of course, the two control members 22 can also be connected and located close to the first ends of each of the two adjustment plates 20. By operation of the control members 22, the two adjustment plates 20 are pivotable relative to an axis of the hollow tube 12 respectively. Each of the two adjustment plates 20 includes a row of positioning teeth 24 defined in an underside thereof (FIG. 2) and the hollow tube 12 includes two single tooth 181 extending from the flat top surface 15 thereof. The single tooth 181 is engaged with one of the positioning teeth 24 of each of the two adjustment plates 20 so as to position the adjustment plates 20 when the adjustment plates 20 are pivoted.

A top cover 30 is mounted to the two adjustment plates 20 and has multiple guide holes 31 and the nozzles 171 extend through the guide holes 31. The hollow tube 12 includes multiple engaging notches 16 defined in two sides thereof and the top cover 30 has engaging blocks 32 which are engaged with the engaging notches 16. The top cover 30 has an open bottom and two engaging slits 33 are defined in each of two sides thereof. The two control members 22 are integrally connected to each of the two adjustment plates 20 by two connection rods 23 which are engaged with the engaging slits 33 of the top cover 30.

Figure 7:
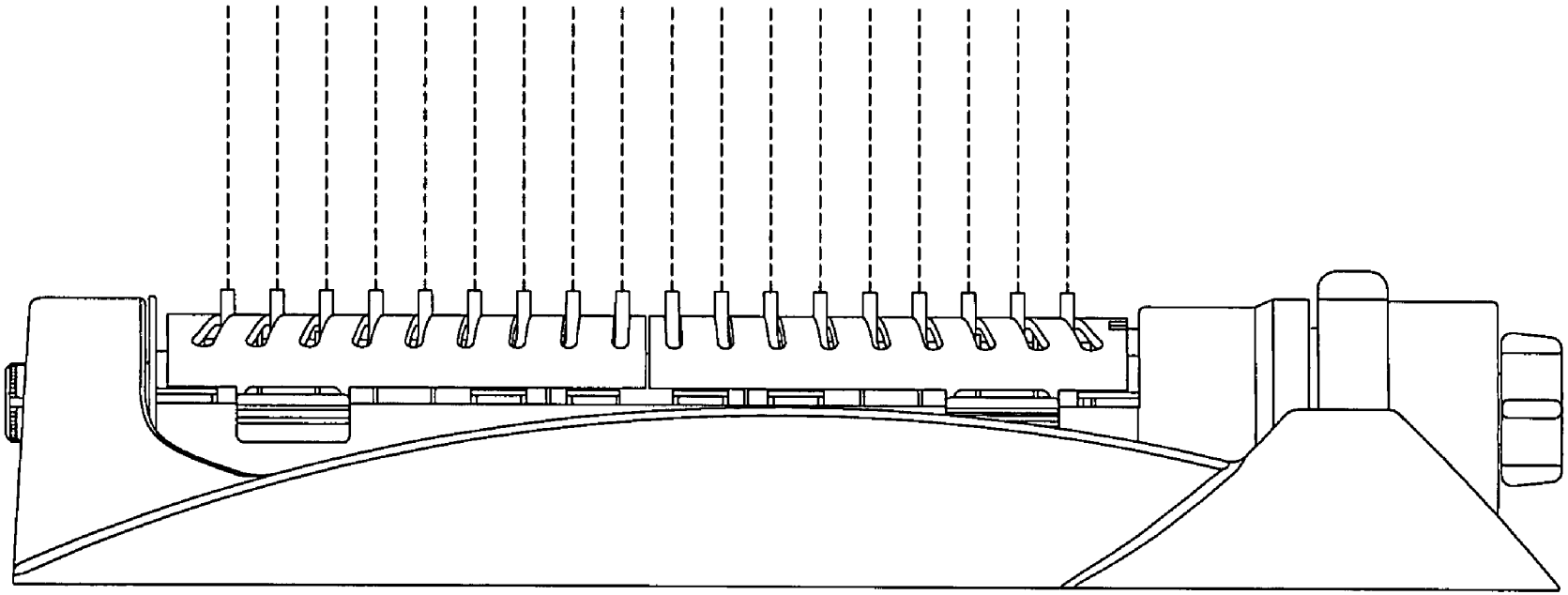
FIGS. 7-11 show different patterns that the oscillating sprinkler of the present invention may perform.
Figure 8:
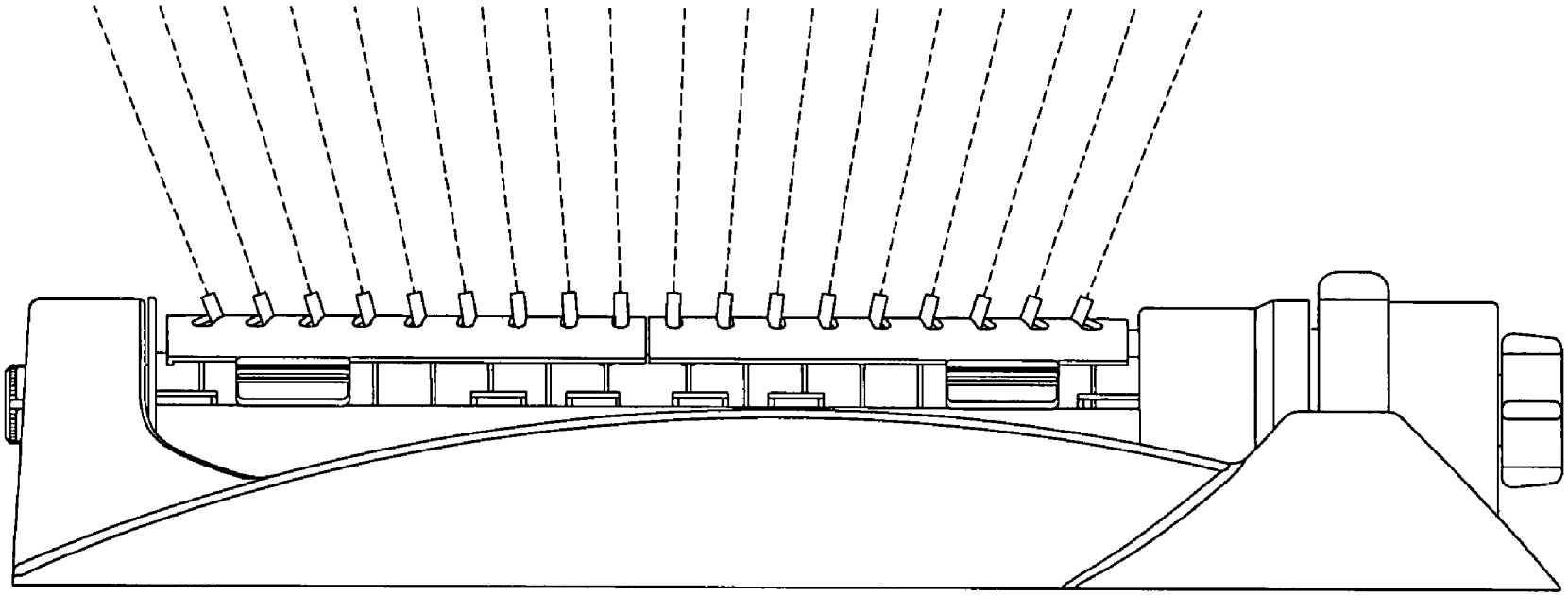
Figure 9:
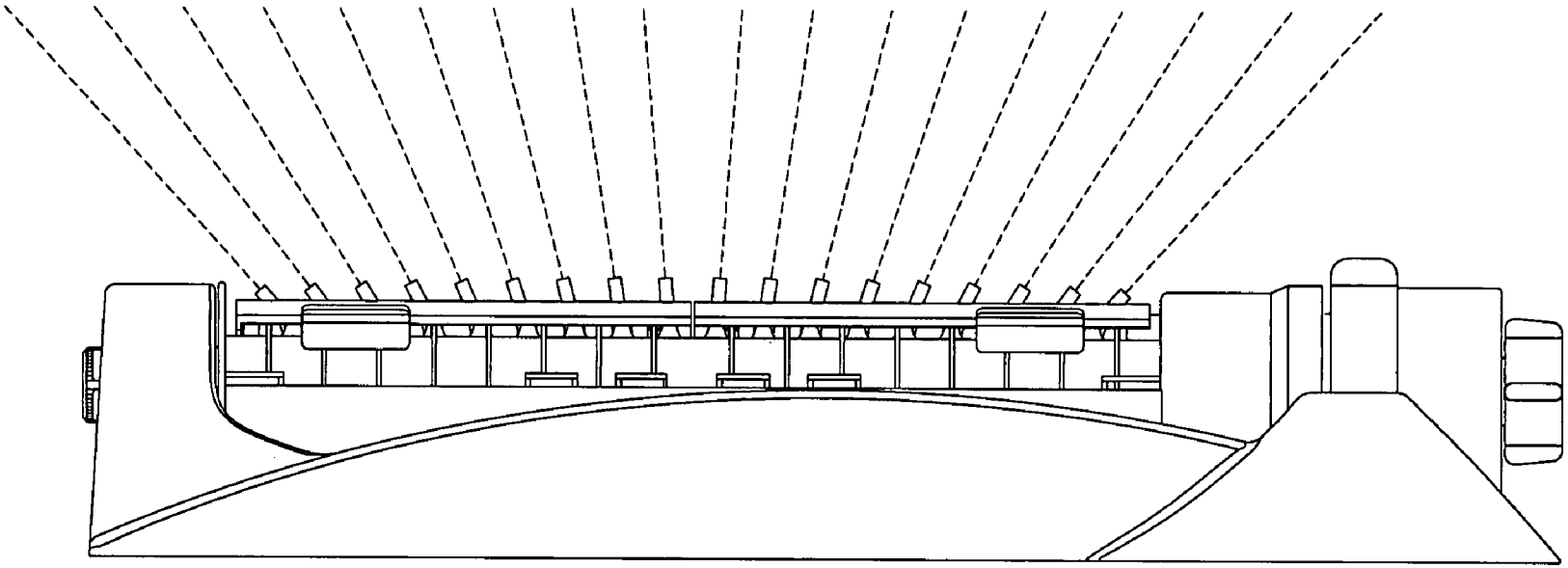
Figure 10:
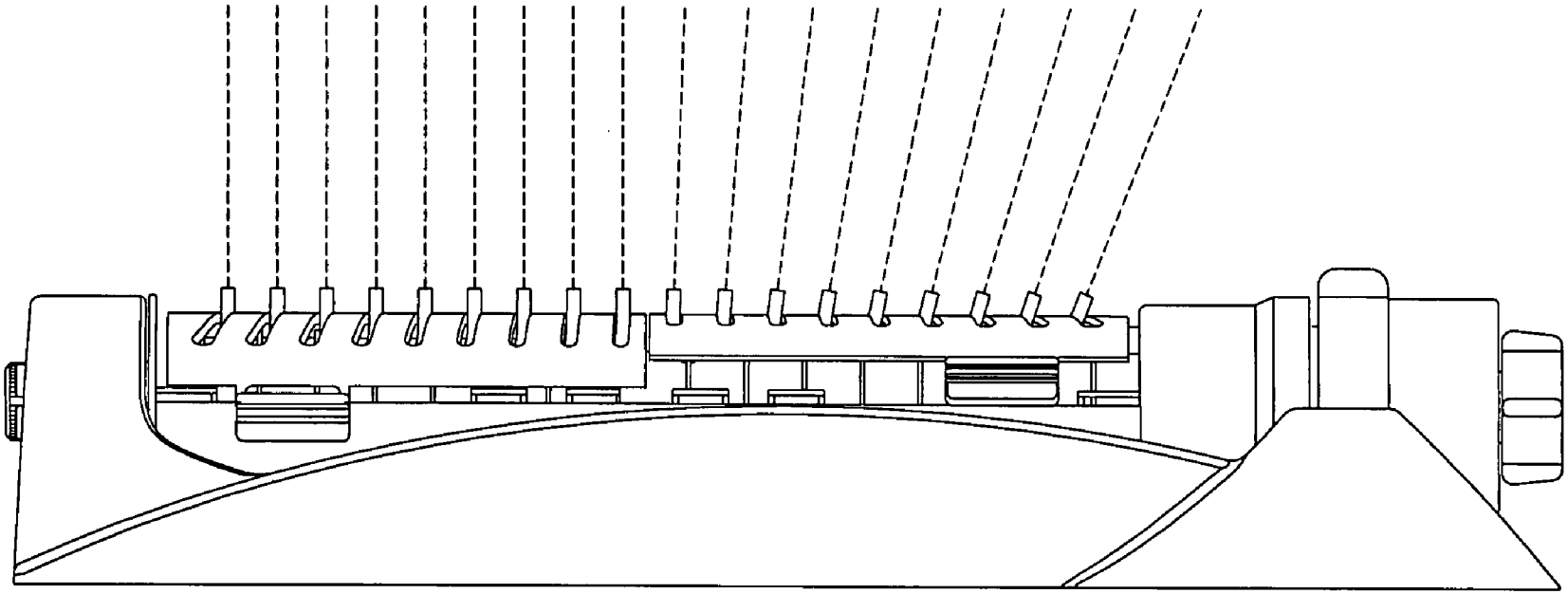
Figure 11:
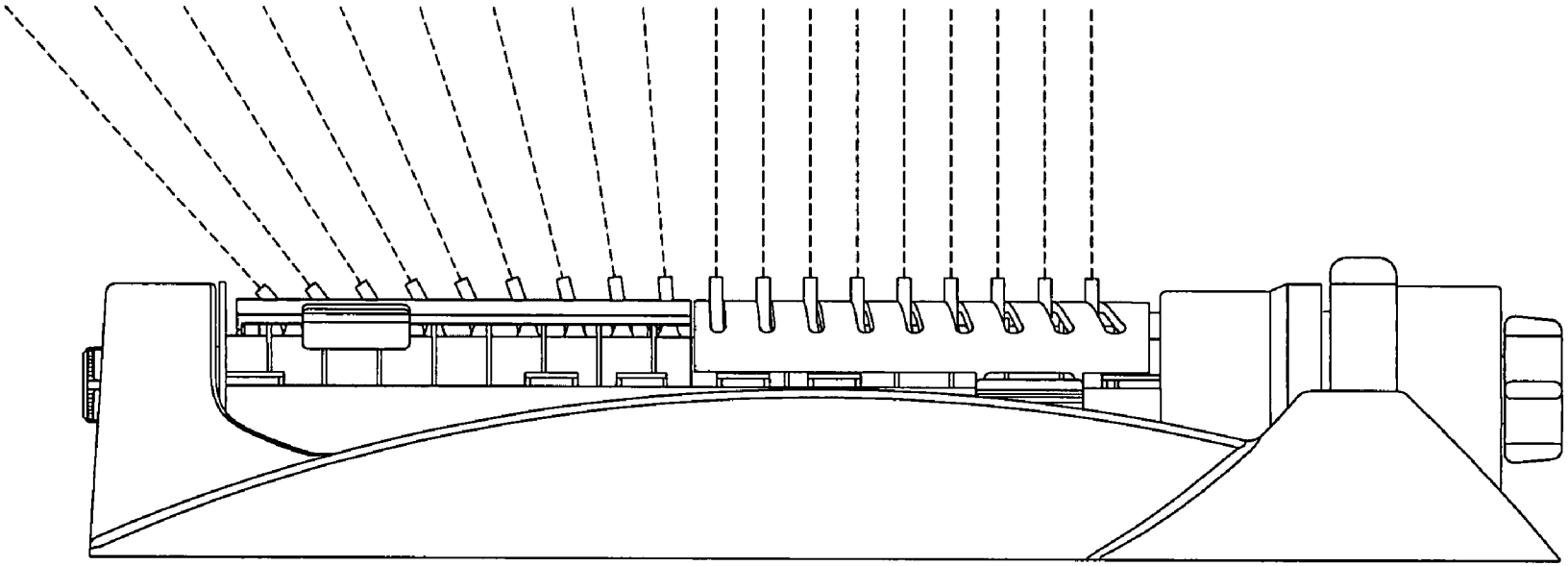

FIGS. 7 to 11 show different patterns that the oscillating sprinkler of the present invention may perform. FIG. 7 shows that the nozzles 171 are arranged to point upward so that the water coming out from the nozzles 171 forms parallel water streams. FIGS. 8 and 9 show that the nozzles are arranged to have an angle relative to vertical line so as to have a fan-shaped water curtain. FIGS. 10 and 11 show that the two adjustment plates 20 are respectively pivoted so that the nozzles 171 of the adjustment plate 20 that is pivoted and the nozzles 171 of the adjustment plate 20 that is not adjusted point different directions.

FIGS. 12-16 to show the second embodiment of the oscillating sprinkler of the present invention, wherein the second embodiment is the same as the first embodiment except that the control members 22 are connected to two sides of each of the adjustment plates 20 and located close to the first end thereof. It is noted that the position for the control members 22 can also be located at the mediate portion of each of the adjustment plates 20.

Figure 23:
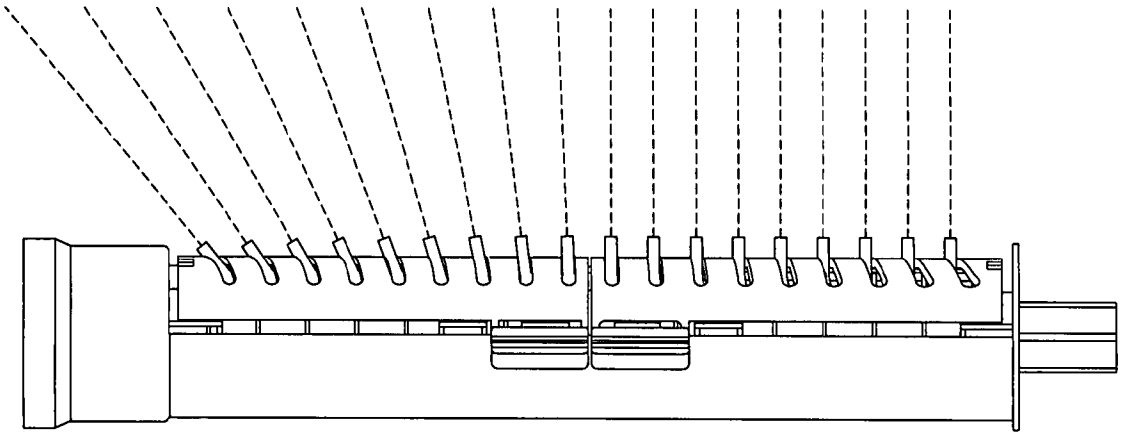
Figure 24:
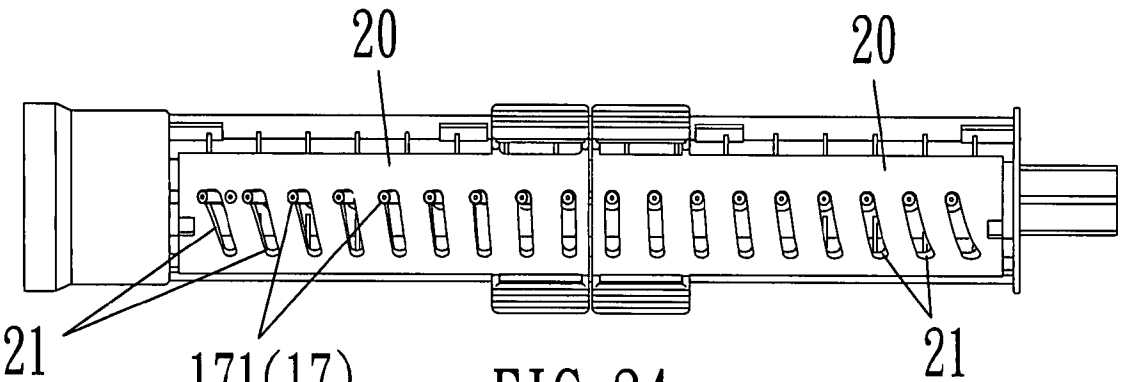

FIGS. 17-24 to show the third embodiment of the oscillating sprinkler of the present invention, wherein the third embodiment is the same as the first and second embodiments except that the guide slots 21 of the two adjustment plates 20 have the same arrangement. The guide slot 21 at the second end of each of the two adjustment plates 20 are located on two parallel lines (not shown), the rest of the guide slots 21 of each adjustment plate 20 are gradually inclined an angle. FIGS. 23 and 24 show that when the two adjustment plates 20 are pivoted to the same direction, the nozzles 171 of one adjustment plate 20 eject parallel upright water streams and the nozzles 171 of the other adjustment plate 20 perform a fan-shaped watering pattern.

Figure 25:
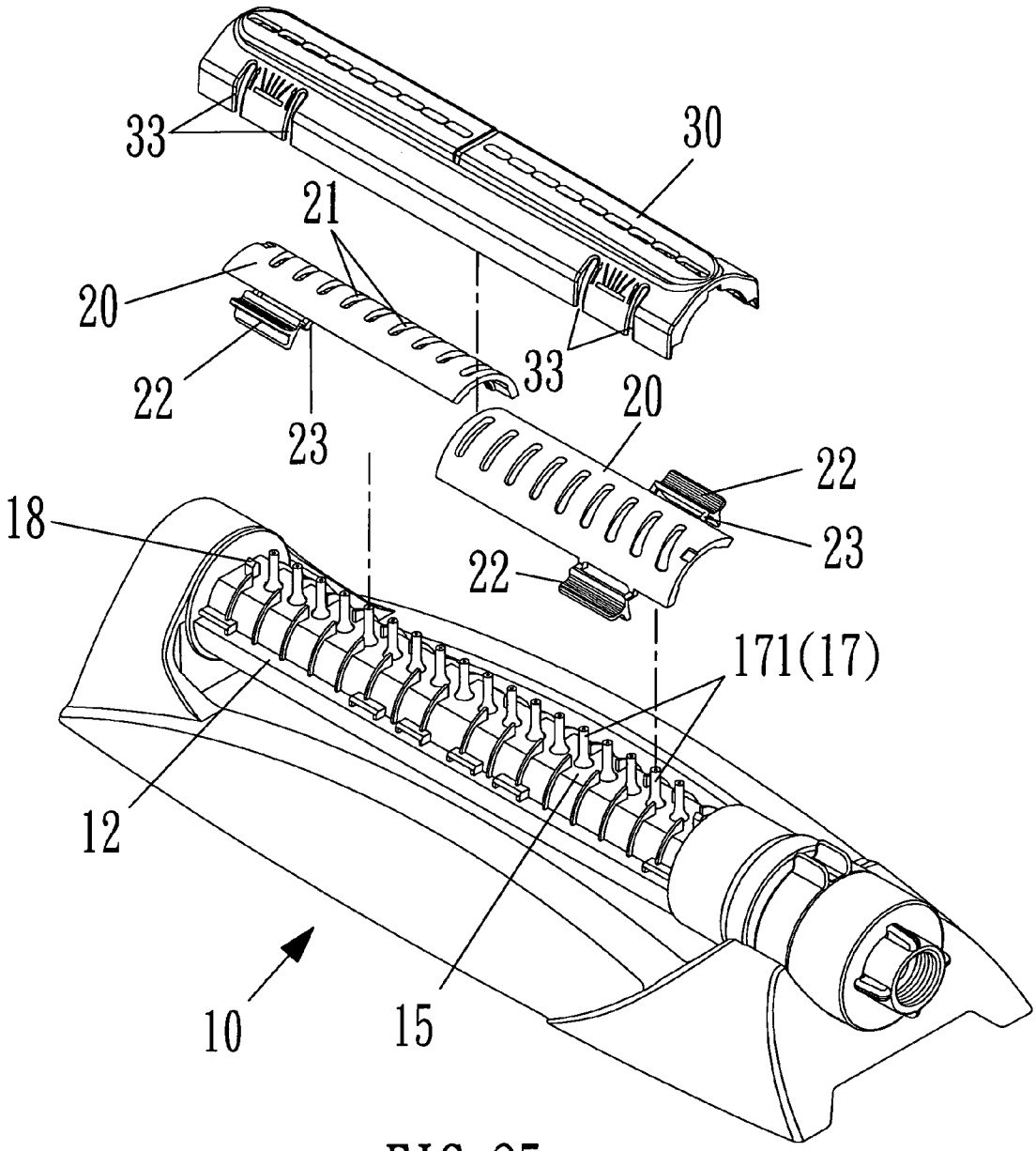
FIG. 25 is an exploded view to show the fourth embodiment of the oscillating sprinkler of the present invention.
Figure 26:
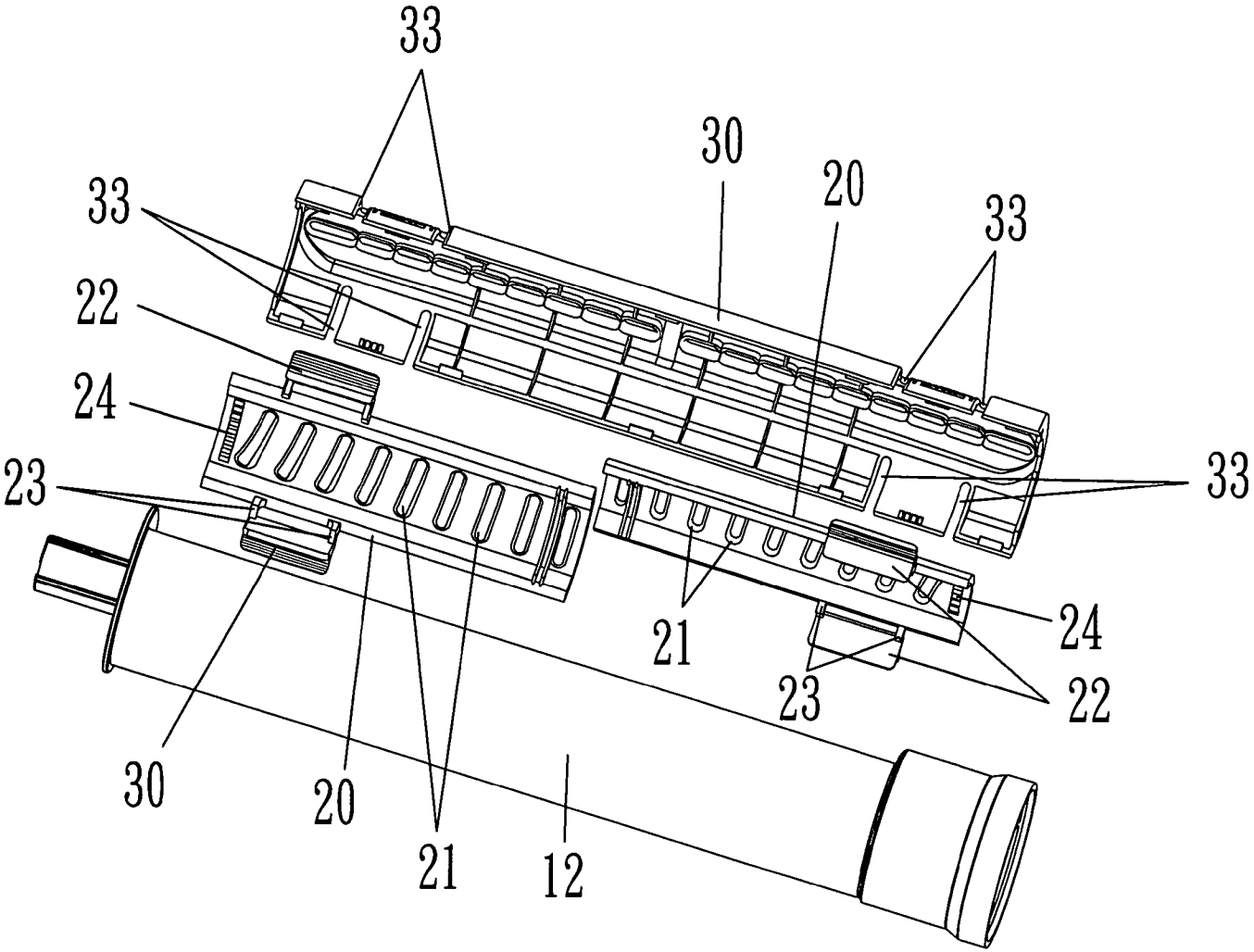
FIG. 26 shows a bottom view of the adjustment plates and the top cover of the fourth embodiment of the oscillating sprinkler of the present invention.

FIGS. 25-32 to show guide slots 21 of the two adjustment plates 20 have the same arrangement. FIGS. 25 and 26 show that when pivoting the two adjustment plates 20, the single tooth 181 is engaged with one of the positioning teeth 24 of each of the two adjustment plates 20 so as to position the adjustment plates 20.

Figure 27:
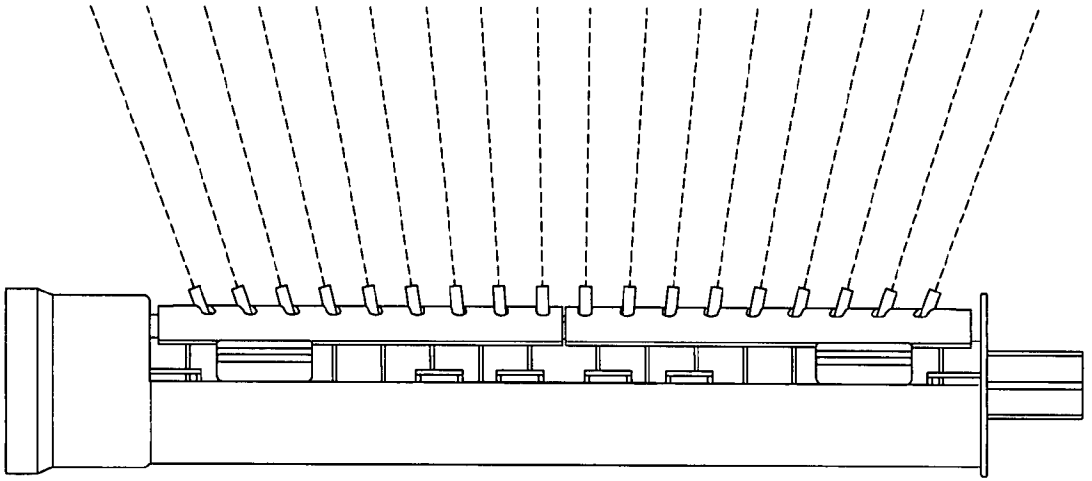
FIGS. 27-32 show different patterns that the oscillating sprinkler of the fourth embodiment of the present invention may perform.
Figure 28:
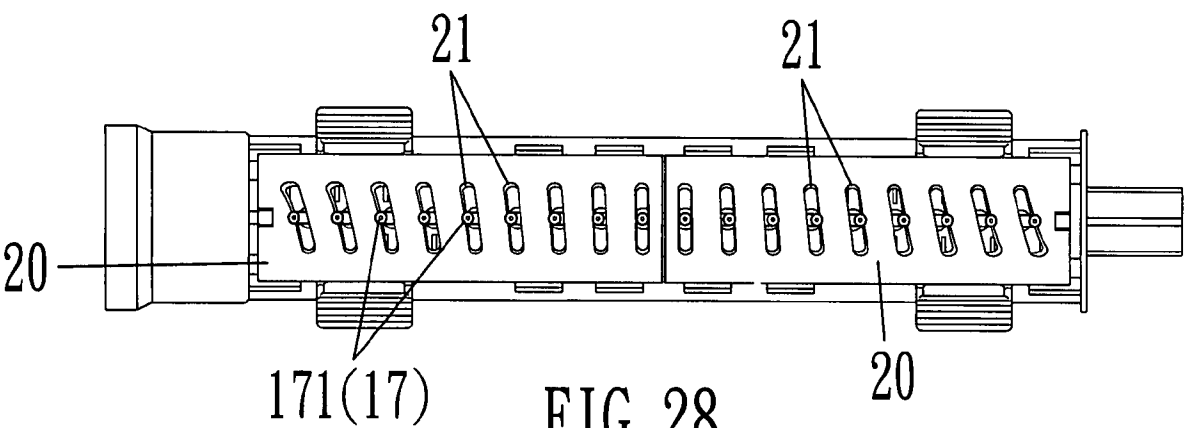
Figure 29:
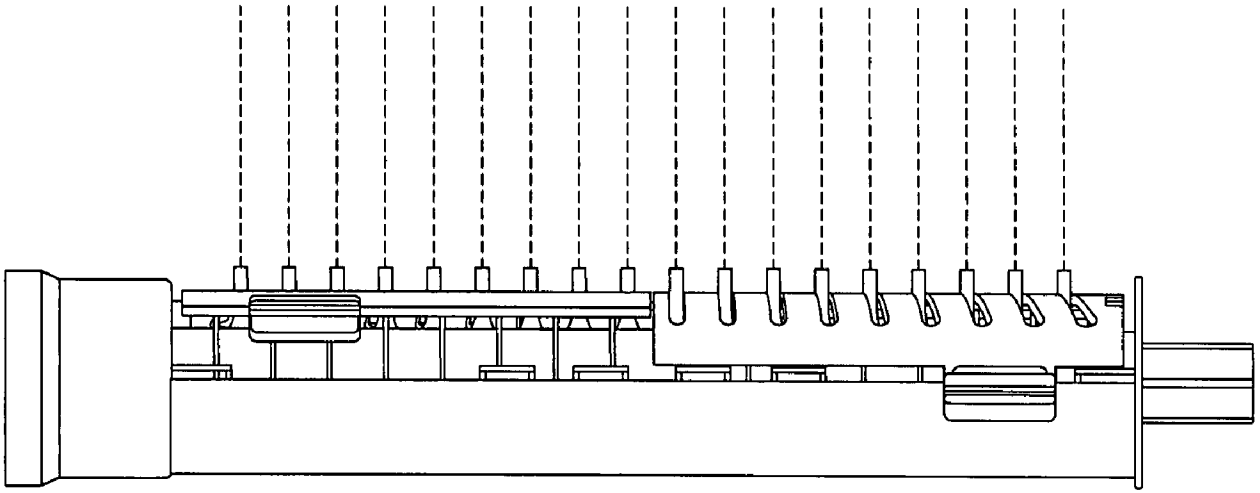
Figure 30:
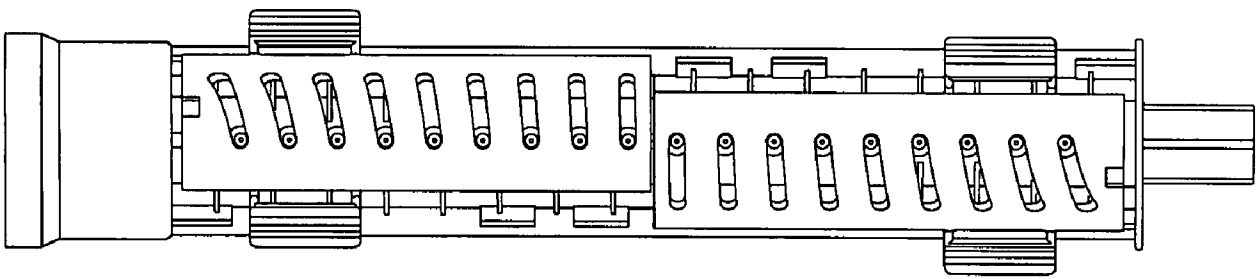
Figure 31:
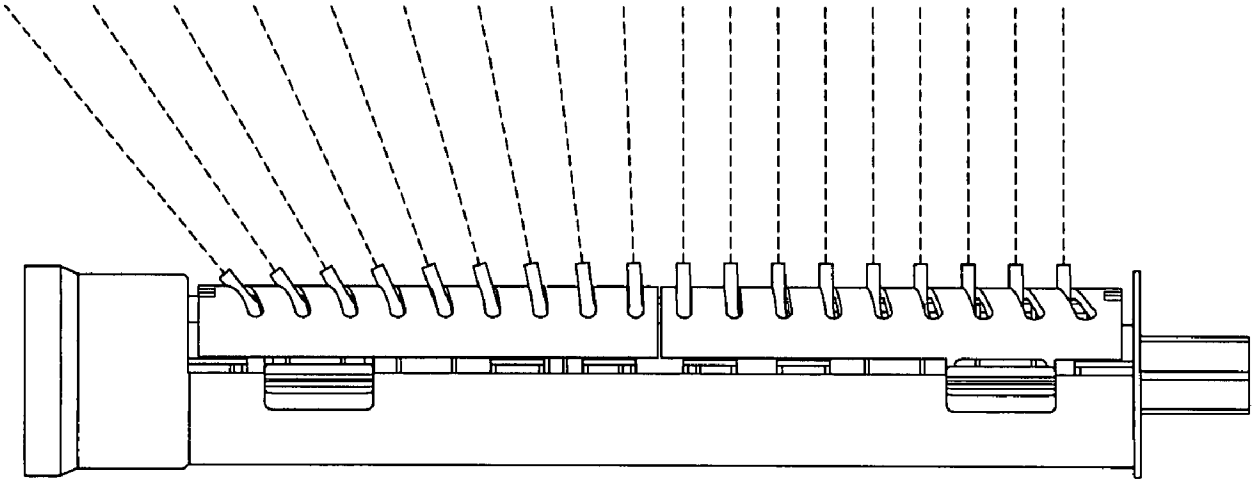
Figure 32:
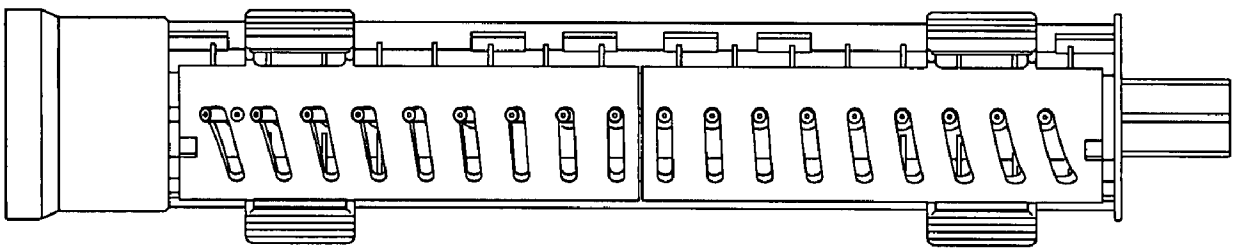

FIGS. 27 and 28 show that when the two adjustment plates 20 are pivoted to let the nozzles 171 located at the mediate portions of the guide slots 21, a fan-shaped watering pattern is obtained. FIGS. 29 and 30 show the two adjustment plates 20 are pivoted in two opposite directions and FIGS. 31 and 32 show that the two adjustment plates 20 are pivoted to the same direction the nozzles 171 of one adjustment plate 20 eject parallel upright water streams and the nozzles 171 of the other adjustment plate 20 perform a fan-shaped watering pattern.

Figure 33:
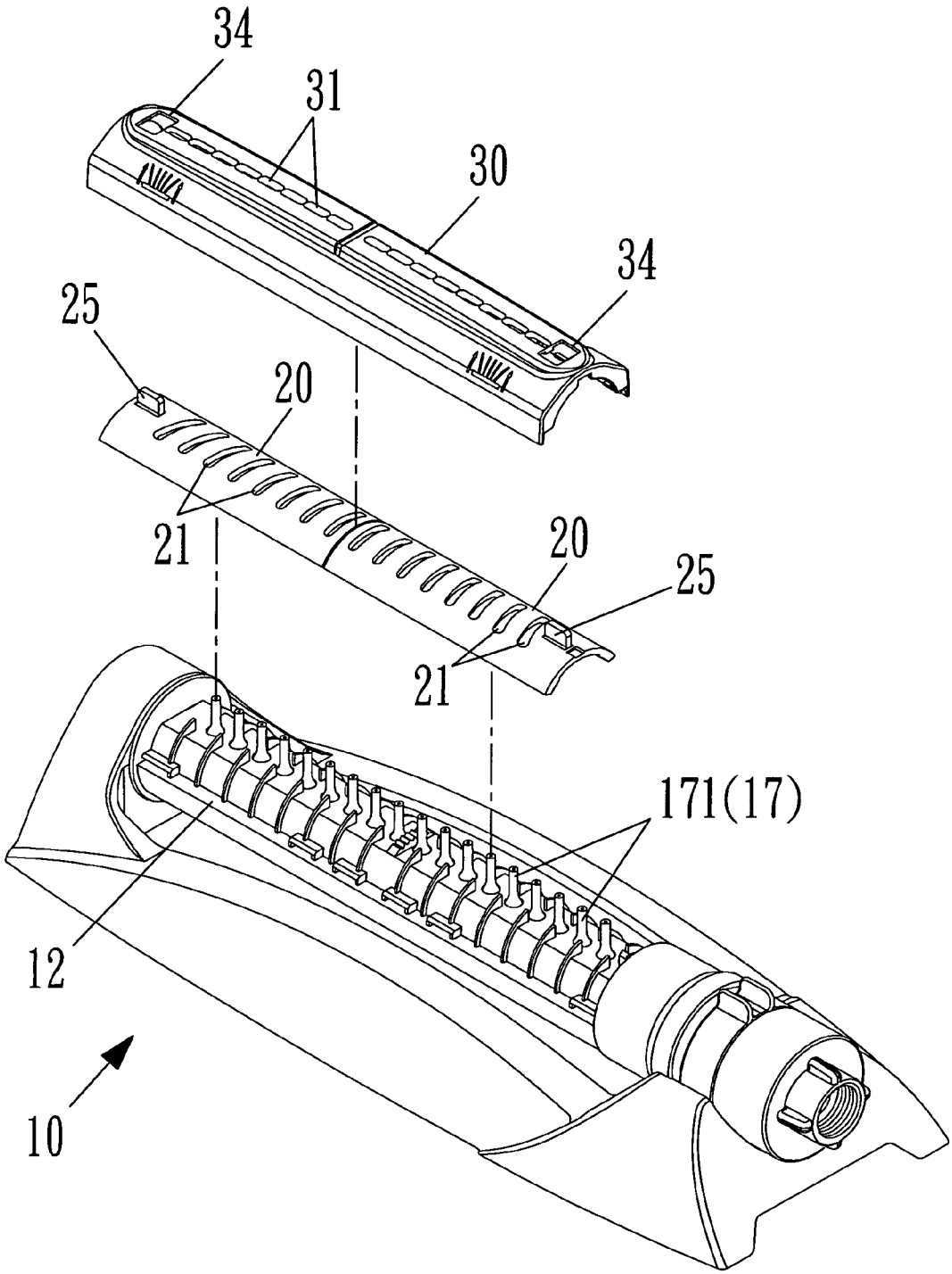
FIG. 33 is an exploded view to show the fifth embodiment of the oscillating sprinkler of the present invention.
Figure 34:
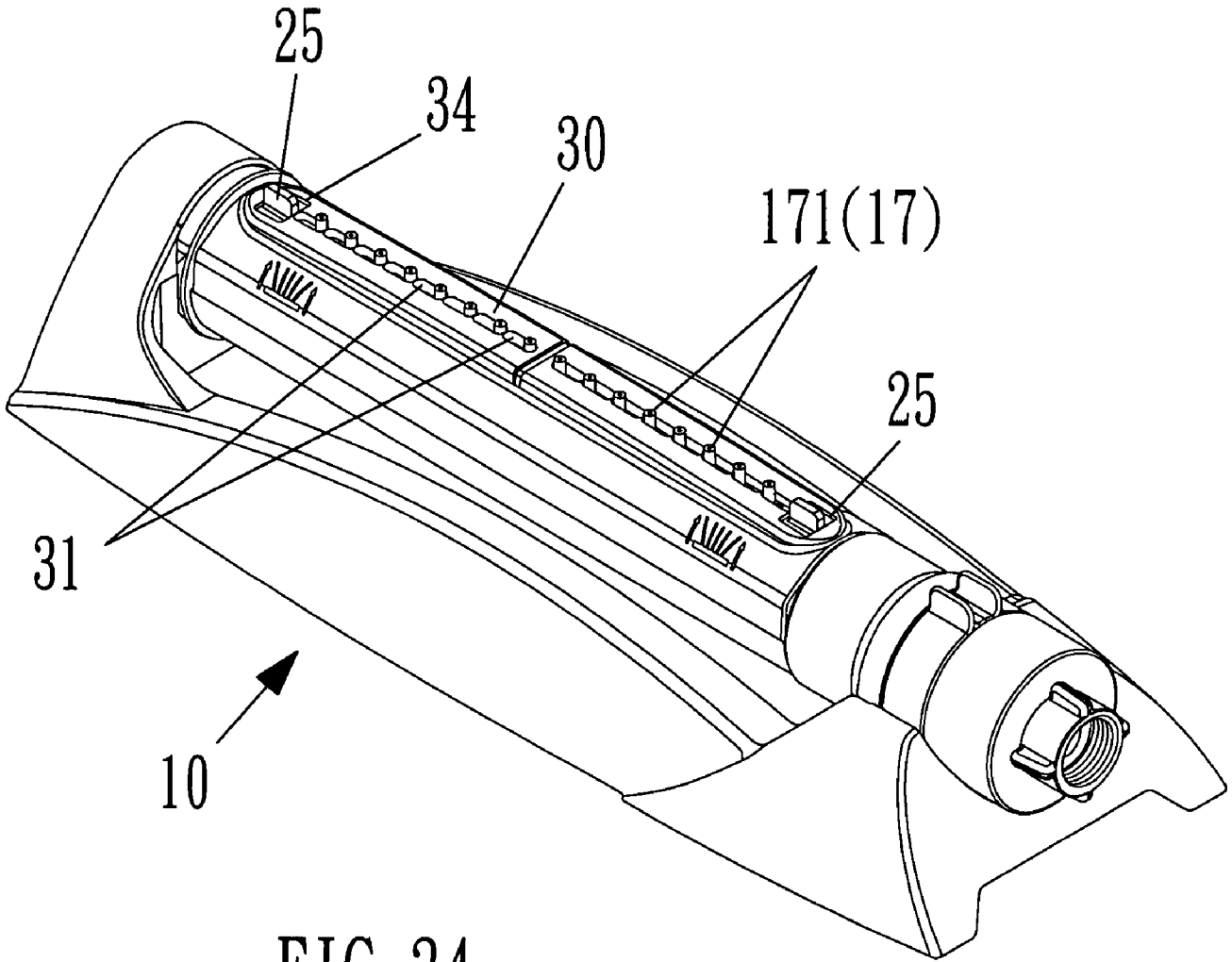
FIG. 34 is a perspective view to show the fifth embodiment of the oscillating sprinkler of the present invention.

FIGS. 33 and 34 show the fifth embodiment of the oscillating sprinkler of the present invention, wherein the control members 22 are changed to be two upright boards 25 extending from the top of the adjustment plates 20 respectively. The top cover 30 includes two adjustment openings 34 through which the two upright boards 25 extend. The two adjustment openings 34 can be pivoted by operation of the upright boards 25.

While we have shown and described the embodiment in accordance with the present invention, it should be clear to those skilled in the art that further embodiments may be made without departing from the scope of the present invention.

What is claimed is:

1. An oscillating sprinkler comprising:

a body having a hollow tube connected thereto, the hollow tube having a flat top surface and a plurality of holes defined through the flat top surface;

a nozzle unit received in the hollow tube and having a plurality of nozzles;

two adjustment plates mounted to the flat top surface of the hollow tube and two first ends of the two adjustment plates being in contact with each other, two respective second ends of the two adjustment plates located on two respective opposite ends to the two respective first ends, each adjustment plate having a plurality of guide slots and the nozzles extending through the holes and the guide slots, two control members connected to two sides of each of the adjustment plates and located close to the first or the second end of each of the adjustment plates, the two adjustment plates being pivotable relative to an axis of the hollow tube respectively, and a top cover mounted to the two adjustment plates and having multiple guide holes and the nozzles extending through the guide holes.

2. The sprinkler as claimed in claim 1, wherein the top cover has an open bottom and two engaging slits are defined in each of two sides thereof so as to be engaged with the control members on the adjustment plates.

3. The sprinlder as claimed in claim 1, wherein each of the two adjustment plates includes a row of positioning teeth defined in an underside thereof and the hollow tube includes two single tooth extending from the flat top surface thereof, the single tooth is engaged with one of the positioning teeth of each of the two adjustment plates.

4. The sprinkler as claimed in claim 1, wherein the hollow tube includes multiple engaging notches defined in two sides thereof and the top cover has engaging blocks which are engaged with the engaging notches.

5. The sprinkler as claimed in claim 1, wherein a length of the two adjustment plate is the same as a length of the hollow tube.

6. The sprinkler as claimed in claim 1, wherein the two respective guide slots located close to the two respective first ends of the two adjustment plate are parallel to each other, the rest of the guide slots are gradually inclined at an angle.

7. The sprinkler as claimed in claim 1, wherein the two control members are located on the two sides of the first ends of each of the two adjustment plates.

8. The sprinlder as claimed in claim 1, wherein the two control members are located on the two sides of the second ends of each of the two adjustment plates.

9. The sprinkler as claimed in claim 1, wherein the two control members are integrally connected to each of the two adjustment plates by two connection rods which are engaged with the engaging slits of the top cover.

* * * * *